US009790735B2

(12) United States Patent
Trott

(10) Patent No.: US 9,790,735 B2
(45) Date of Patent: Oct. 17, 2017

(54) PROTECTIVE ADDITIONAL GLAZING SYSTEMS, APPARATUS AND METHODS FOR STRUCTURAL OPENINGS

(71) Applicant: IMPACT SECURITY LLC, Palm Harbor, FL (US)

(72) Inventor: Gary Robert Trott, Napean (CA)

(73) Assignee: IMPACT SECURITY LLC, Palm Harbor, FL (US)

( * ) Notice: Subject to any disclaimer, the term of this patent is extended or adjusted under 35 U.S.C. 154(b) by 0 days.

(21) Appl. No.: 15/098,241

(22) Filed: Apr. 13, 2016

(65) Prior Publication Data

US 2016/0298938 A1 Oct. 13, 2016

Related U.S. Application Data

(60) Provisional application No. 62/146,549, filed on Apr. 13, 2015.

(51) Int. Cl.

| | |
|---|---|
| ***F41H 5/24*** | (2006.01) |
| ***E06B 5/10*** | (2006.01) |
| ***F41H 5/013*** | (2006.01) |
| ***F41H 5/04*** | (2006.01) |
| ***E06B 3/28*** | (2006.01) |
| ***E06B 9/00*** | (2006.01) |

(52) U.S. Cl.

CPC ..... *E06B 5/106* (2013.01); *E06B 3/28* (2013.01); *E06B 5/10* (2013.01); *E06B 9/00* (2013.01); *F41H 5/013* (2013.01); *F41H 5/0407* (2013.01); *E06B 2009/005* (2013.01)

(58) Field of Classification Search

CPC ..... E06B 5/106; F41H 5/013; F41H 5/0407

USPC ..... 89/36.04; 52/202; 428/221

See application file for complete search history.

(56) References Cited

U.S. PATENT DOCUMENTS

| | | | | |
|---|---|---|---|---|
| 1,989,305 A * | 1/1935 | Bartuska | E06B 3/64 | 52/172 |
| 3,175,603 A * | 3/1965 | Tonnon | E06B 7/08 | 160/107 |
| 4,193,235 A * | 3/1980 | Cucchiara | E06B 3/285 | 160/380 |
| 4,243,719 A * | 1/1981 | Holmes | B32B 17/10 | 156/106 |
| 4,470,222 A * | 9/1984 | Killingsworth | E06B 3/28 | 49/419 |
| 4,671,031 A * | 6/1987 | Intengan | E06B 3/28 | 52/203 |
| 4,685,261 A * | 8/1987 | Seaquist | E06B 9/02 | 49/463 |

(Continued)

*Primary Examiner* — Samir Abdosh

(74) *Attorney, Agent, or Firm* — Phillips Ryther & Winchester; Matthew D. Thayne

(57) ABSTRACT

Protective glazing systems, apparatus, and associated methods for the protection of structural openings against impacts from projectiles from any cause, including nature or man. In some embodiments, the system may comprise a substantially unbreakable and clear or opaque panel, which may be at least substantially the same size (length and width) as the visible glass being protected, and may be anchored to the original glazing via standoff and/or anchor elements. Another embodiment may comprise a substantially unbreakable, ballistic-tolerant panel cut slightly larger than the visible original glazing being protected, said panel being attached to the structural opening via standoff and/or anchor means.

14 Claims, 5 Drawing Sheets

(56) References Cited

U.S. PATENT DOCUMENTS

| | | | | | |
|---|---|---|---|---|---|
| 4,812,359 | A * | 3/1989 | Hall | B32B 17/10018 | 156/105 |
| 5,494,715 | A * | 2/1996 | Glover | B44F 1/063 | 156/107 |
| 5,950,380 | A * | 9/1999 | Pearson | E06B 5/106 | 52/204.5 |
| 6,079,168 | A * | 6/2000 | Shaver | E06B 9/02 | 49/464 |
| 6,155,009 | A * | 12/2000 | Pena | E06B 9/02 | 52/171.3 |
| 6,161,605 | A * | 12/2000 | Pena | E06B 9/0669 | 160/105 |
| 2005/0193651 | A1* | 9/2005 | Kirk | E06B 9/04 | 52/202 |
| 2016/0145934 | A1* | 5/2016 | Trott | E06B 5/11 | 52/203 |

* cited by examiner

PROTECTIVE ADDITIONAL GLAZING SYSTEMS, APPARATUS AND METHODS FOR STRUCTURAL OPENINGS

RELATED APPLICATIONS

This application claims the benefit under 35 U.S.C. §119 (e) of U.S. Provisional Patent Application No. 62/146,549 filed Apr. 13, 2015 and titled "Protective Additional Glazing Systems, Apparatus, and Methods for Structural Openings," which application is incorporated herein by reference in its entirety.

DESCRIPTION OF THE RELATED ART

In an increasing violent society, businesses, educational institutions, and homes are subject to an increased number of threats against life, liberty and property. These threats can include ballistic threats, threats of explosive blasts, forced entry threats, and others. Businesses and homes in all areas are increasingly forced to employ security measures to protect against these threats. These security measures can include electronic surveillance, window films, and the installation of glazing with increased strength. For example, bullet resistant glazing or glazing that can resist various impacts and attempts at intrusion are finding their way onto both residential and industrial buildings.

Additionally, buildings in areas that are subject to natural disasters, such as hurricanes, tornadoes and other severe storms, require impact resistance and resistance to major changes in ambient air pressures to protect the building envelope and in so doing it protects both contents and occupants. This is now being mandated by Insurance companies in many areas. With climate change concerns, families, businesses, and governments seek effective yet low-cost means to protect structures and lives.

The most common form of forced-entry is via glass windows and door glazings which is the most vulnerable aspect of all buildings. In an attempt to harden the envelope conventional security protection schemes often require that the existing window and frame be removed and replaced with a new, stronger glazing and framing system. Because the old windows need to be removed first before the new windows and frames can be installed, the costs of such jobs are greatly increased. Moreover, lead times to supply the frames and glazing and the area downtime, that is, the time required for workmen to come in, tear down the existing structure, and install the new structure, is also substantial. Furthermore, there is a risk of contamination to the work-area resulting from the demolition and reconstruction of the frame and surrounding building structure. This of course affects the occupants who need the building for their daily living or business needs.

Another disadvantage of conventional schemes is that the noise, commotion and disruption inherent in tearing out the old frame and existing building materials, in addition to the significant down-time, precludes a discreet security enhancement. Because of the conspicuous nature of conventional schemes, they may unnecessarily cause fear in the workplace or unwittingly reveal to third parties the additional security measures.

In many cases, impact glass and window films are used to add security. However, with both of these solutions, under impact, the glass usually breaks and it is easily defeated thus allowing intruders to breech the protection and loot, harm individuals and wreak havoc in a very short period of time, even if alarm systems are tripped. Both systems enable intruders to both enter and escape through the breached opening. The key is to keep intruders out of the protected premises until first responders can arrive in about 3 to 5 minutes and the current conventional systems do not accomplish that. Additionally the broken glass is a hazard that must be cleaned up and must be replaced adding cost, and disruption.

Another disadvantage is that conventional frames and methods to install them are costly, time-consuming with long lead times, and require two or more workers to aid in positioning the glass or glazing in the frames, and the normal operations of the building occupants is compromised especially if the weather or climate is inclement, requiring the addition of plastic sheeting, or plywood, etc., to protect the interior.

Accordingly, there remains a need in the industry for an effective but reasonably priced solution, such as in some embodiments and implementations a retrofit solution, that will protect the original glass and will be stronger at forced-entry resistance than current alternatives, with the intent being that the intruder will be kept out of the building until first responders can arrive. Some embodiments may be innocuous enough that it does not detract from the original appearance of the buildings and may be installed quickly without affecting the envelope of the building or disturbing the normal functioning of the occupants. Some embodiments may have an additional benefit of adding insulation to improve heating/cooling costs, reduce UV radiation, protect from graffiti defacement, and attenuate sound, thereby quietening the environment and promoting a more pleasant place to work or to live.

DETAILED DESCRIPTION

Referring to the figures, exemplary embodiments of the invention will now be described. The exemplary embodiments are provided to illustrate aspects of the invention and should not be construed as limiting the scope of the invention. The exemplary embodiments are primarily described with reference to the figures.

For purposes of this description the following definitions are being adopted:

The phrase "inside of frame" means the surface of the original and existing frame that is perpendicular to both the protective panel and the glazing pane being protected.

The phrase "on-frame" means any embodiment in which the protective panel is slightly larger than the glazing being protected and said protective panel is adhered to the frame by a double-sided taping and/or another means for anchoring the protective panel to a glazing (an "anchor means") and/or a means for creating a spacing or standoff between the protective panel and the glazing (a "standoff means").

The phrase "in-frame" means any embodiment in which the protective panel is recessed into the existing frame/mullion with an anchor/stand-off which is bonded to the existing frame and to the protective panel.

The phrase "on glass" means any embodiment in which the protective panel is anchored to the visible perimeter of the original glazing with a double-sided tape and/or another anchor means and/or standoff means.

Figure 1A:
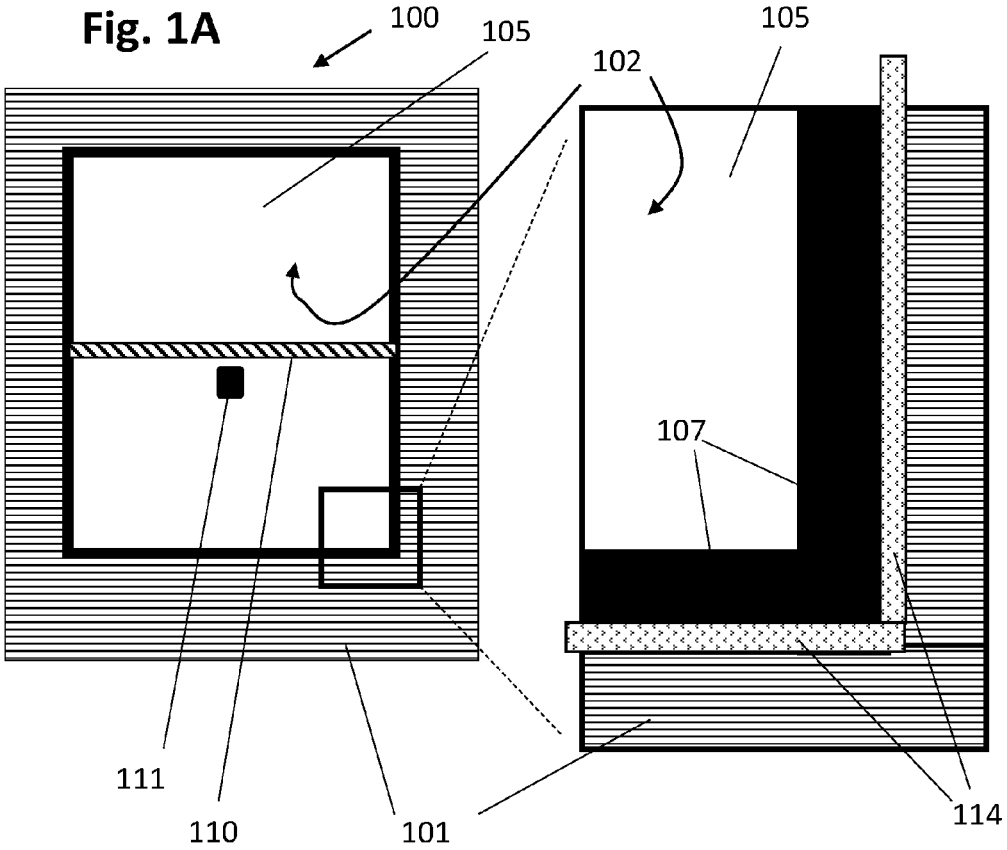
FIG. 1A is a front elevation view of an embodiment covering a window frame with an exploded view of the bottom right corner.
Figure 1B:
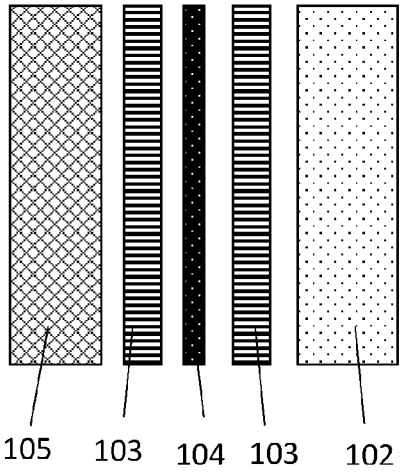
FIG. 1B is a side cross-sectional view highlighting the components of the standoff/anchor means between the protective panel and original glazing.

FIG. 1A illustrates an embodiment in which system 100 is viewed from the outside of a building and may cover the glazing 102 mounted within frame 101. Frame 101 may be a part of a door or a window that slides or a window that is fixed. Behind an optional decorative covering 107 (which may be known as "edge banding") may be the protective panel 105 and one or more components of the standoff and/or anchor means. FIG. 1B further illustrates this embodiment in which protective panel 105 may be anchored directly to original glazing 102 with standoff/anchor components that may comprise the following: double-sided tape 103, stand-off component 104, which may preferably comprise a solid stand-off component, and a second double-sided tape 103. Double-sided tape 103 may be one of many types depending upon the needs of a particular installation. As used herein, "double-sided tapes" have a core material to which the same or different bonding agents are placed on each side. These core materials may be made of one or more components depending upon the application. These cores may be comprised of, for example, rubber, acrylic, foam and/or other materials. In applications where impact resistance is important, at least one of the double-sided tape layers may be made of a relatively compressible material, such as a compressible foam material, that may disperse shock more readily than a denser core material. In some embodiments, double-sided tape 103 may be a very high bond tape (VHB tape) that has a denser core material from a manufacturer like 3M™. Alternatively, the double-sided tape may consist of an acrylic adhesive with foam material from Essentra™. VHB tape may eliminate rivets, bolts, screws and welds, and the need to drill holes and to use screws, etc., that would mar the normally clean installation of the existing framework and likely void the window warranty. Drilling holes into the panels also weakens the panel and may make the panel relatively easy for intruders to remove. The special acrylic adhesive forms strong bonds with polycarbonate, glass, vinyl, plastics and both painted and unpainted metals.

Double-sided tapes may also comprise any non-permanent tape system in which two halves may be affixed together on one side via a mechanical means like Velcro® or VHB snap-back tape. One system uses "mushroom" shaped caps which interlock creating a secure form of attachment which is easily applied with pressure until a "snap" is heard, confirming that the panel is securely attached to the building. The panel can be applied and removed hundreds of times. One side of the double-sided tape system may remain permanently on the building while its mate may be permanently attached to the panel. In some embodiments, the tape may be configured so as to not alter, or at least not permanently alter, the appearance of the building.

It should be noted that the greater a standoff distance, the less change of a strike on the protective panel breaking the glass, however, in many instances, given the costs involved and sometimes inability to provide a standoff (no depth to frame), the best possible capability includes almost zero to a minimal standoff distance between the protective panel and original glazing. Under this scenario, the glass may break, but the intruder will not be able to violate the protective panel. Thus, the standoff distance comprising the components of 103, 104, and 103, may add up to between about 0.100" and about 1.000" in standoff depth.

Figure 1C:
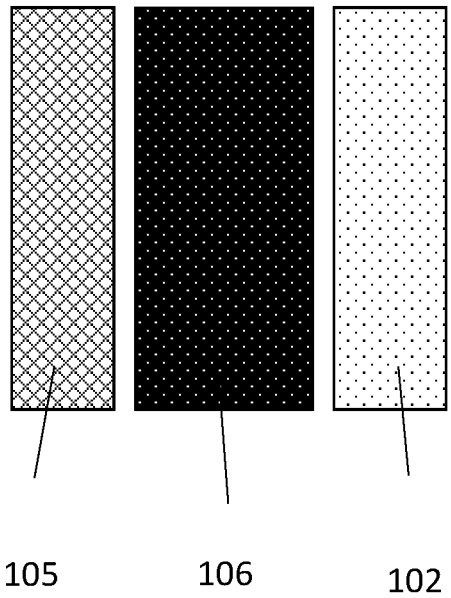
FIG. 1C is a cross-sectional view of another embodiment.

In an alternative embodiment shown in FIG. 1C, protective panel 105 is joined to original glazing 102 via cushion tape 106 alone. Cushion tape 106 may comprise a core of material that preferably has a height greater than 0.100 inches, and preferably has cushioning qualities to absorb impacts. The core material in cushion tape 106 may be sandwiched between very high strength adhesives that line two opposite sides. One side may adhere to the original glazing 102 and the other side may adhere to the protective panel 105. Essentra Specialty Tapes custom makes this type of foam tape for this application.

Figure 1D:
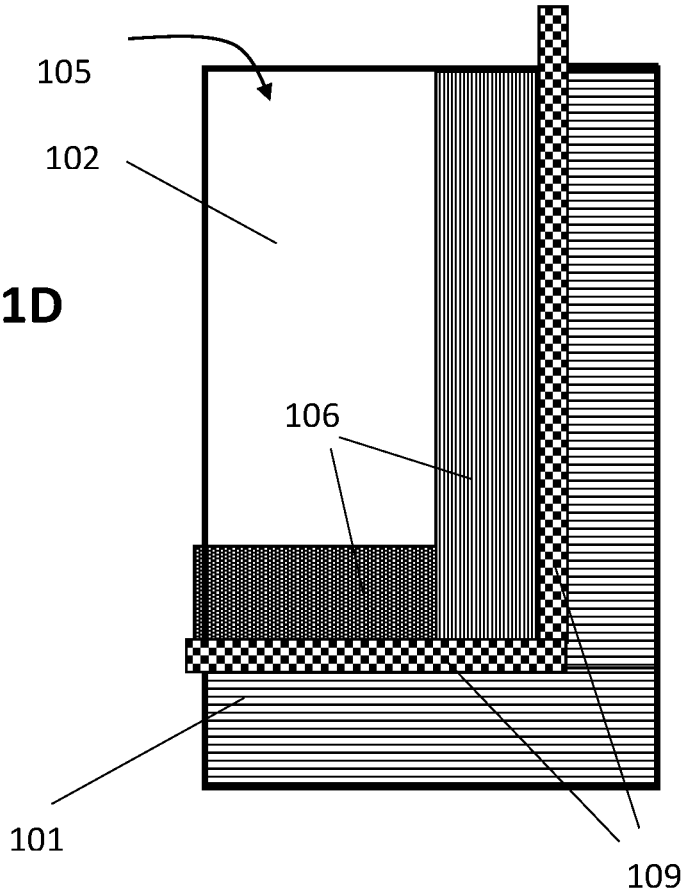
FIG. 1D is a cross-sectional view of still another embodiment.

In some embodiments, the cushion tape 106 may be adhered to one or more edges (in some embodiments, all edges) of the protective panel 105 either at the edge or near the edge(s), as depicted in the embodiment of FIG. 1D. In some embodiments, the gasket that secures the original glazing may encroach onto the glass, thus the cushion tape 106 may be inset slightly from the true edge of protective panel 105 because the gasket will not permit adequate adhesion. In some embodiments, an additional strip of material, e.g., like brush weather stripping 109, may be placed between the panel edge and cushion tape 106 in order to keep sealant 114, as shown in FIG. 1*a*, from becoming visible on the panel to those inside the structure.

It should be noted that the greater a standoff distance, the less change of a strike on the protective panel breaking the glass, however, in many instances, given the costs involved and sometimes inability to provide a standoff (no depth to frame), the best possible capability includes almost zero to a minimal standoff distance between the protective panel and original glazing. Under this scenario, the glass may break, but the intruder will not be able to violate the protective panel. Thus, the standoff distance created by cushion tape 106 may be between about 0.100" and about 1.000" in depth in some embodiments.

In some embodiments, the original glazing may be substantially larger than the size of one or more of the protective panels. In such embodiments, two or more panel systems 100 may be adhered in a pattern to fit over the entire original glazing.

Because protective panel 105 may flex when struck, the larger the protective panel, the higher the possibility of the flexing protective panel striking the original glazing. Thus, in some embodiments, one or more cushioning pads 111 (FIG. 1A) may be adhered to either or both of the original glazing 102 or the protective panel 105. When the protective panel is struck, the force transmits to the cushion and begins to accelerate the glass in a direction away from the incoming protective panel, thus reducing the likelihood of impact.

Protective panel 105 may be cut with one or more outer dimensions at least approximately equal to or slightly less than that of the visible original glazing 102. Solid stand-off component 104 may be comprised of, for example, any material with two flat horizontal sides (that may adhere to the protective panel 105 and the original glazing 102) including, but not limited to, wood, metal or plastic, and may be of any shape or profile including, but not limited to, U-channel or flat strips which may have rectangular profiles for optimal complimentary adherence qualities. Protective panel 105 may be bonded with double-sided tape 103 or, in other embodiments, another suitable adhesive, to solid stand-off component 104, which may be bonded to a second double-sided tape 103, which may be bonded to original glazing 102. This embodiment is designed to protect the original glazing from breaking, however, if sufficient force does cause the original glazing to break, the protective panel in most cases will remain in place and prevent intrusion by means of forced entry and/or forces of nature.

In some embodiments, protective panel 105 may be shaped to the same, or at least substantially the same, dimensions of the visible underlying glazing being protected including, but not limited to, trapezoidal, circular, rectangular or oddly shaped openings. It may be clear or opaque, wood, metal, or plastic. In preferred embodiments, a polycarbonate plastic may be used that permits light to pass yet is extremely resistant to forces of nature or man. Protective panel 105 may be selected from, but is not limited to, Bayer Makrolon GP polycarbonate, Lexan XL10, Lexan Makrolon, or various multiwall polycarbonate sheet material. Various other polycarbonate sheet materials may be used depending on the application, even up to ballistic grade. One potential panel material is Bayer Makrolon, or Lexan polycarbonate sheet, having a polished surface, is optically clear, can be UV stabilized, and is a transparent sheet product. It features outstanding, virtually unbreakable, light weight, with superior dimensional stability, high temperature resistance, and high clarity. Other polycarbonate sheet products can also be used offering a variety of physical properties useful for the intent of this invention. Sheet products can be tinted or etched depending on the client requirements.

In some embodiments, decorative covering 107 (which may also be known as "edge banding") may be used to camouflage the components beneath. This camouflage feature may be useful in order to hide from view the standoff means, anchor means, and/or adhesive means. This may also help inhabitants not feel like they are incarcerated and/or may fool crime perpetrators into not realizing the protection is in place making it more difficult to detect and overcome the system. Edge banding 107 may, for example, comprise a UV protected PVC tape with adhesive on one side; the other side may be color-matched to the frame for colors and textures including metallic views. Edge banding tape may, but need not, contribute to structural integrity. It may be of particular importance for buildings that need to maintain their "curb appeal" (such as stores), and for educational institutions that desire a secure environment that does not appear to be fortress-like.

In some embodiments, to prevent liquid, vermin, and other air-borne debris intrusion, a sealant, such as a clear sealant, may be applied around panel 105 and/or opening frame 101. This sealant should be compatible with the panel 105 and form a strong bond with it and all frame materials.

In other embodiments, a reinforcing mullion 110 may be added if the opening is of sufficient size that the panel 105 might deflect and impact the original glass. Such mullions may be constructed from aluminum and other materials, and may be affixed to the original frame behind panel 105 via adhesive means or traditional hardware.

Figure 2A:
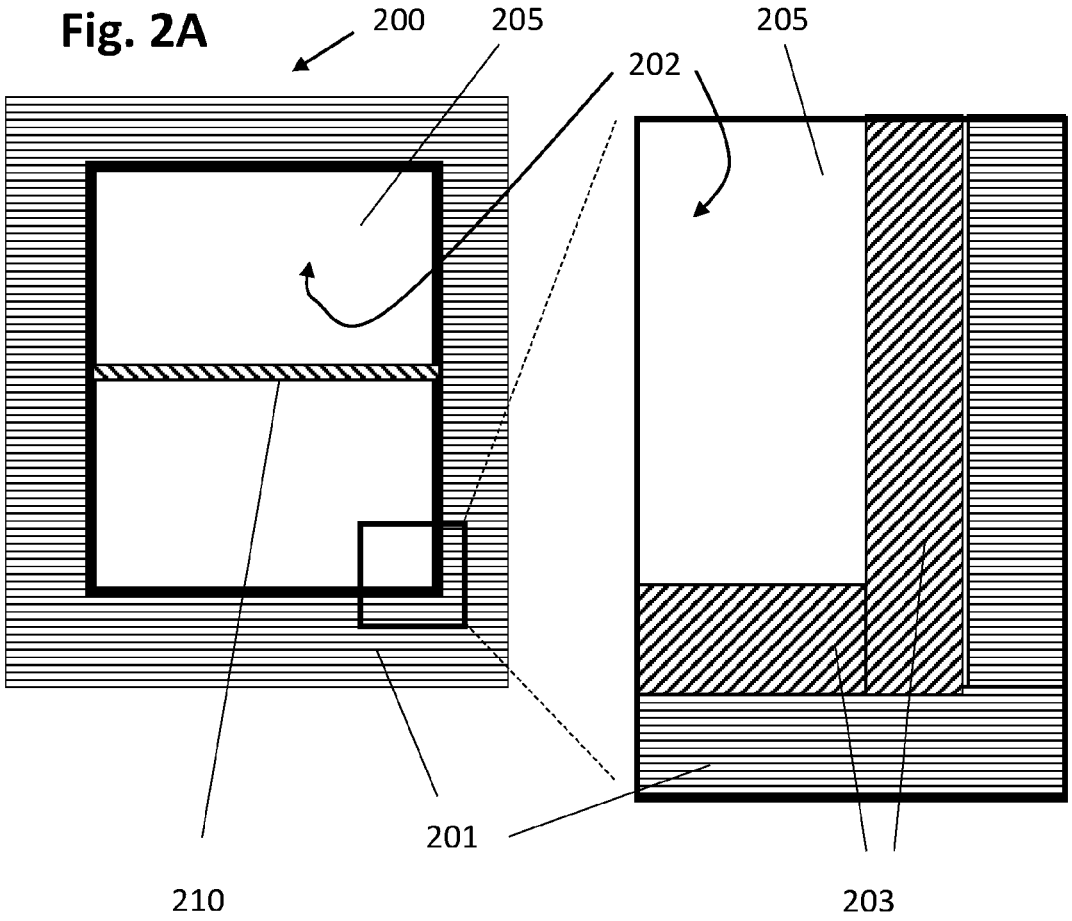
FIG. 2A is a front elevation view of an embodiment covering a window frame with an exploded view of the bottom right corner.
Figure 2B:
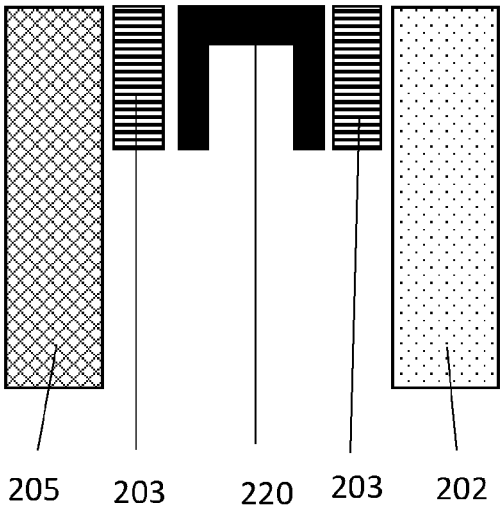
FIG. 2B is a top-down cross-sectional view highlighting the components of the standoff/anchor means between the protective panel and original glazing.

FIG. 2A illustrates the top-down cross-sectional view of an embodiment in which system 200 may cover the glazing 202 within frame 201, which could be a part of a door or a window that slides or a window that is fixed. The protective panel may, in some embodiments, be positioned behind an optional decorative covering 207 and one or more components of the standoff and/or anchor means. In this embodiment, standoff means comprises a U-shaped member, which allows for providing a suitable space in between glazing 202 and protective panel 205. FIG. 2B further illustrates this embodiment in which protective panel 205 may be anchored to glazing 202 with standoff and/or anchor components that may comprise one or more of the following: double-sided tape 203, solid stand-off U-Channel component 220, and second double-sided tape 203. Double-sided tape 203 may be one of many types depending upon the particular installation as discussed above in the FIG. 1 specification.

Protective panel 205 may be cut with outer dimensions equal to or slightly less than that of the visible original glazing 202. Solid stand-off component 220 in this embodiment is a U-channel which may have the opening of the "U" away from the frame with the bottom of the "U" as close to the frame as possible. The U-channel may be comprised of any material including, but not limited to, metal or plastic. Panel 205 may be bonded with double-sided tape 203 to an outside of the U-channel 220 which may be bonded to double-sided tape 203 which may be bonded to original glazing 202. This embodiment is designed to protect the original glazing from breaking, however, if sufficient force does cause the original glazing to break, the protective panel in most cases will remain in place and prevent unauthorized entry of people, a or other forces of nature.

Figure 3A:
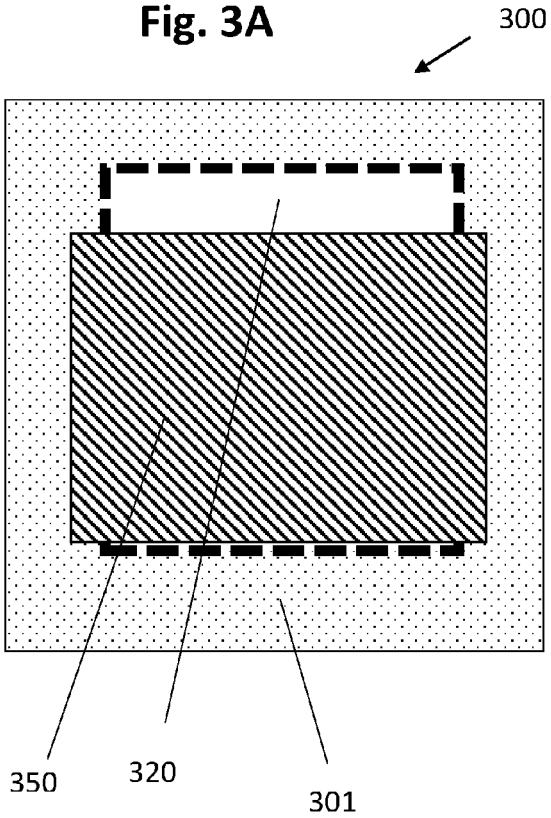
FIG. 3A is a front elevation view of a ballistic panel mounted upon a door/window.
Figure 3B:
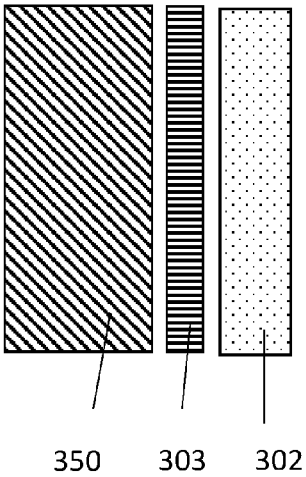
FIG. 3B is a side cross-sectional view of the on-frame ballistic system.

FIG. 3A is the back view of an embodiment that may comprise a ballistic panel 350 mounted on the inside of a window or door-window (the side on which people need protection). System 300 shows door and/or window frame 301 in which original glazing 302 (hidden in FIG. 3A, but visible in FIG. 3B) is mounted. Ballistic panel 350 may be mounted on frame", in frame", or "on glass." In FIG. 3A, ballistic panel 350 is mounted "on frame" which means that the width and/or length of ballistic panel 350 exceeds the corresponding dimension of the visible glazing 320 so that double-sided tape 303 may be used to affix the ballistic panel 350 to original frame 301 on two or more sides. FIG. 3B shows a side-view of a cross-section in which the ballistic panel 350 may be mounted "on frame." Ballistic panel 350 may be cut to the length and/or width of the original glazing plus at least 1 inch. Double-sided tape 303 may be affixed to the perimeter of ballistic panel 350 which may then be adhered to framing 301.

Figure 3C:
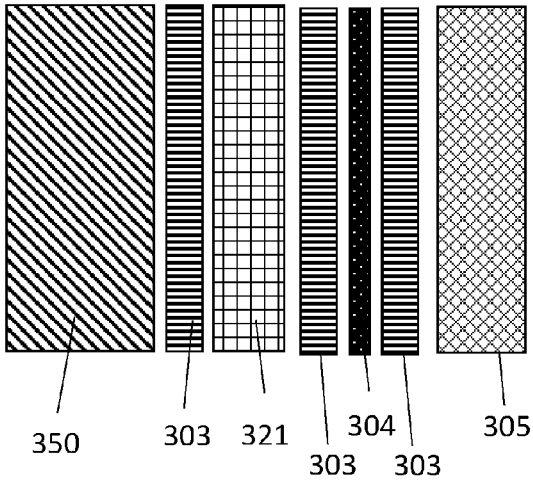
FIG. 3C is a side cross-sectional view of an on-glass ballistic system on the inside of the door/window and the protective panel system on the outside of the door/window.

FIG. 3C shows an alternative embodiment in which the ballistic panel 350 may be mounted "on glass" and not on frame as with the previous embodiment. In this embodiment, ballistic panel 350 may be cut to the length and/or width of the original glazing or slightly less. Double-sided tape 303 may be used to adhere ballistic panel 350 to original glazing 321.

In order to strengthen this anti-ballistic system, this embodiment may include the protective panel systems of 100 and 200 and/or the "in frame" and "on frame" systems, as described in copending U.S. patent application Ser. No. 14/934,125 titled "Protective Additional Glazing Systems, Apparatus, and Methods For Structural Openings," which application is hereby incorporated by reference herein in its entirety, being installed on the outside of the door and/or window to prevent anyone from attempting to break the original glazing in order to circumvent the ballistic panel 350. FIG. 3C illustrates an "on glass" installation of protective panel 305 on the outside of the opening (the side of would-be attackers). Protective panel 305 may be cut to dimensions equal to or slightly less than the visible glazing 321. Double sided tape 303 may initially be placed around the inside perimeter of protective panel 305 and attached to anchor/standoff means 304 which may be adhered to original glazing 321 via another double-sided tape 303. As discussed previously, a range of double-sided tapes exist to ensure the proper type is used for a particular installation, e.g., some requiring more impact cushioning, etc.

As shown in FIG. 3A, ballistic panel 350 may not cover the entire, original glazing. Given the weight and thicknesses of ballistic panels as of the date of this writing, the dimensions of the ballistic panel 350 need only prevent a shooter from aiming at a would-be victim on the other side of the opening. Thus, as in FIG. 3A, the ballistic panel may only cover a portion of the opening, for instance, the lower one-third or lower one-half of an opening. The extension of the ballistic panel above 6'3" in height may not be needed in some embodiments. In an alternative embodiment, a film that "frosts" the original glazing 321 may be applied to any original glazing that is not covered by ballistic panel 350 in order to distort the vision of a would-be attacker; in the case of FIG. 3A, the portion of original glazing 321 may be so covered for such effect.

Figure 3D:
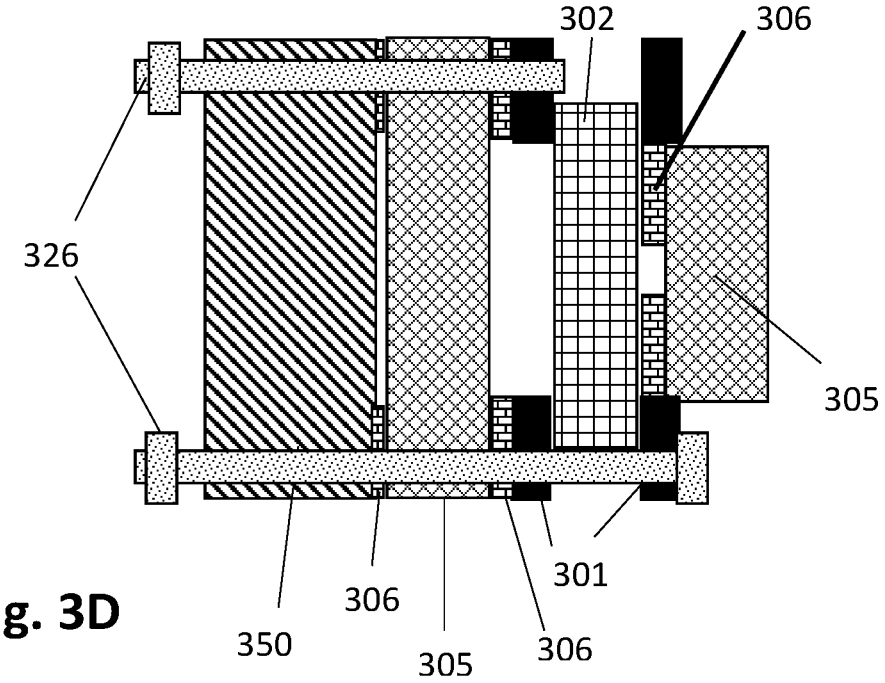
FIG. 3D is a cross-sectional view of yet another embodiment.

In another embodiment, FIG. 3D illustrates the top view of an embodiment configured to trap broken glass after impact. From the outside to inside, beginning with the shooter's side, a protective panel may be mounted on the door frame or on the door glass as discussed herein. In this embodiment, the protective panel 305 is mounted to the frame 301 using a very high bond double sided tape 306 or other suitable adhesive. This provides a first barrier of protection and will slow incoming projectiles. Next is positioned the original glazing 302 set within frame 301. A second protective panel 305 is mounted using another very high bond tape 306 or other suitable adhesive and may cover the entire opening being mounted "on frame." Finally, the ballistic panel 350 is positioned behind the second protective panel 305 and adhered to it using still another very high bond tape 306 or suitable adhesive. In some embodiments, the inside panels 350 and 305 may be bolted to the frame as in the case of the top bolt, or through-bolted and trapping/encapsulating the protective panel 305 on the outside of the opening. With this embodiment, if a projectile or blast breaks the glass, the glass will be trapped by the protective panel between the door frame and the ballistic panel.

The method by which the protective panel system is assembled and/or installed may also be important. These initial steps may take place at an assembly location or at the job site. First, the protective panel may be cut to the proper size. If it is to be mounted on frame, a cut larger than the opening is recommended. If it is to be mounted on glass or within the frame, a cut approximately ⅛" smaller than the opening is recommended. Next, the standoff and/or anchor means may be affixed to either the perimeter of the glass (after the glass has been cleaned), but is preferably affixed to the perimeter of the protective panel after having removed one of the two backings on the standoff/anchor means. Next, a decorative edge-banding may be affixed to the outside of the panel. Next, at the site of installation, any remaining liners on the adhesive may be removed, and the panel is mounted on glass that has been cleaned. Next, an adhesive caulking may be applied to the separation between the protective panel and the frame. Next, time is required to permit the adhesives to cure to enable the strongest bond possible.

The following are various more particular examples of embodiments of the invention described herein.

In a first example of a retrofit system that protects existing glazings on buildings from being penetrated, the system may comprise:

a protective panel having dimensions slightly less than the dimensions of the frame and/or the underlying exposed glass; and standoff and/or anchor means adhered to the edges or very near the edges of the perimeter of the glazing-facing side of the protective panel. The standoff and/or anchor means may be adhered directly to the original glazing.

2. The glazing protection system of example 1, wherein the glazing is positioned within a window or door.

3. The glazing protection system of example 1, wherein a sealant is dispensed at the edges of each protective panel substantially sealing off the space between the panel and original glazing and reinforcing the strength of the protective system.

4. The glazing protection system of example 1, wherein the protective panel may be made of polycarbonate, acrylic, wood, or metal or any other suitable material.

5. The glazing protection system of example 1, wherein the standoff/anchor means is comprised of a double sided tape with a core exceeding 0.010".

6. The glazing protection system of example 1, wherein the standoff/anchor means is comprised of a double-sided tape adhered to a core material that is adhered to another double-sided tape.

7. The glazing protection system of example 1, wherein the protective panel's dimensions are less than that of the exposed glass in the range of 0.010 to 0.750 inches.

8. The glazing protection system of example 1, wherein the standoff/anchor means provide a gap between the protective panel and original glazing of at least 0.125 inches.

9. The glazing protection system of example 1, wherein the substrate of the adhesive means may be comprised of foam, rubber, plastic or any other substrate that may provide a cushioning effect.

10. The glazing protection system of example 1, further comprising a support mullion in substantially the middle of one dimension that adds support to the protective panel against external impacts.

11. The glazing protection system of example 1, further comprising one or more cushion pads that may be positioned in substantially the center of the panel-glazing configuration and adhered to either or both of the protective panel and the glaze.

12. The glazing protection system of example 1 wherein the standoff anchor means may be comprised of a thick core material adhered to each of the protective panel and original glazing with double-sided adhesive tape.

13. The glazing protection system of example 12 wherein the standoff means may be in the shape of U-channel, box channel, strips of thick material, strips of foam material, and the like.

14. A retrofit system that protects existing glazings on buildings from being penetrated, comprising:

a protective panel having dimensions slightly shorter than the dimensions of the frame and/or the underlying exposed glass; and a standoff/anchor means adhered to the edges or very near the edges of the perimeter of the glazing-facing side of the protective panel, said anchor means being comprised of standoff means and adhesive applied to each of the standoff means meaning the protective-panel side and the glazing side of the standoff means; said standoff/anchor means being adhered directly to the original glazing.

15. The glazing protection system of example 12 wherein the standoff means may be comprised of metal, plastic, wood, or other materials.

16. The glazing protection system of example 1, wherein a sealant is dispensed at the edges of each protective panel substantially sealing off the space between the panel and original glazing and reinforcing the strength of the protective system.

17. The glazing protection system of example 1, wherein the protective panel may be made of polycarbonate, acrylic, wood, or metal.

18. The glazing protection system of example 1, wherein the standoff/anchor means is comprised of a double sided tape with a core exceeding 0.010".

19. The glazing protection system of example 1, wherein the standoff/anchor means is comprised of a double-sided tape adhered to a core material that is adhered to another double-sided tape.

20. The glazing protection system of example 1, wherein the protective panel's dimensions are less than that of the exposed glass in the range of 0.010 to 0.750 inches.

21. The glazing protection system of example 1, wherein the standoff/anchor means provide a gap between the protective panel and original glazing of at least 0.125 inches.

22. The glazing protection system of example 1, wherein the substrate of the adhesive means may be comprised of foam, rubber, plastic or any other substrate that may provide a cushioning effect.

23. The glazing protection system of example 1, further comprising a support mullion in substantially the middle of one dimension that adds support to the protective panel against external impacts.

24. The glazing protection system of example 1, further comprising one or more cushion pads that may be positioned in substantially the center of the panel-glazing configuration and adhered to either or both of the panel and the glaze/glass.

25. A retrofit system that protects glazing and occupants against ballistic attacks, said system being comprised of:

a ballistic-rated protective panel having side dimensions slightly greater than the dimensions of the frame and/or the underlying exposed glass and top/bottom dimensions less than that of the underlying frame and/or exposed glass; and adhesive means to bond the ballistic-rated protective panel to the inside of the door.

26. The glazing protection system of example 25, wherein another protective panel may be mounted via any means to the outside of the door.

27. The glazing protection system of example 25, wherein the ballistic-rated protective panel is positioned to cover that portion of the opening in which the assailant would have the clearest shot at a potential target.

Any methods disclosed herein comprise one or more steps or actions for performing the described method. The method steps and/or actions may be interchanged with one another, where appropriate. In other words, unless a specific order of steps or actions is required for proper operation of the embodiment, the order and/or use of specific steps and/or actions may be modified.

Unless otherwise noted, the terms "a" or "an" are to be construed as meaning "at least one of." In addition, for ease of use, the words "including" and "having" are interchangeable with and have the same meaning as the word "comprising." Recitation of the term "first" with respect to a feature or element does not necessarily imply the existence of a second or additional such feature or element.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment. Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment.

It will be apparent to those having skill in the art that changes may be made to the details of the above-described embodiments without departing from the underlying principles set forth herein. The scope of the present invention should, therefore, be determined only by the following claims.

The invention claimed is:

1. A system for protection of one or more structural glazings, comprising:

a protective panel;

means for creating a standoff between the protective panel and at least one structural glazing, wherein the standoff means is adhered along or adjacent to an edge of a perimeter of the at least one structural glazing and adhered to the at least one structural glazing, and wherein the standoff means is configured to create a gap between the protective panel and the at least one structural glazing; and means for anchoring the protective panel to at least one of the at least one structural glazing and the frame.

2. The system of claim 1, wherein the at least one structural glazing is positioned within a window or door.

3. The system of claim 1, wherein the gap is between 0.100 inches and 1.000 inches.

4. The system of claim 1, wherein the gap is at least 0.125 inches.

5. The system of claim 1, wherein the at least one structural glazing comprises at least one existing structural glazing on a building, and wherein the protective panel is configured to be applied to the at least one existing structural glazing while the at least one existing structural glazing is on the building.

6. The system of claim 1, wherein the standoff means extends only along or adjacent to the edge of the perimeter of the at least one structural glazing.

7. The system of claim 1, wherein the standoff means comprises a U-shaped member.

8. The system of claim 7, further comprising a first double-sided tape coupled between a first side of the U-shaped member and the protective panel and a second double-side tape coupled between a second side of the U-shaped member opposite from the first side and the at least one structural glazing.

9. A system for protection of one or more structural glazings, comprising:

a protective panel;

means for creating a standoff between the protective panel and at least one structural glazing, wherein the standoff means is adhered along or adjacent to an edge of a perimeter of the at least one structural glazing and adhered to the at least one structural glazing, wherein the standoff means is configured to create a gap between the protective panel and the at least one structural glazing, and wherein the standoff means comprises a U-shaped member;

a first double-sided tape coupled between a first side of the U-shaped member and the protective panel; and a second double-side tape coupled between a second side of the U-shaped member opposite from the first side and the at least one structural glazing.

10. The system of claim 9, wherein the at least one structural glazing is positioned within a window or door.

11. The system of claim 9, wherein the gap is between 0.100 inches and 1.000 inches.

12. The system of claim 9, wherein the gap is at least 0.125 inches.

13. The system of claim 9, wherein the at least one structural glazing comprises at least one existing structural glazing on a building, and wherein the protective panel is configured to be applied to the at least one existing structural glazing while the at least one existing structural glazing is on the building.

14. The system of claim 9, wherein the standoff means extends only along or adjacent to the edge of the perimeter of the at least one structural glazing.

* * * * *